US006167986B1

(12) United States Patent
Calvillo

(10) Patent No.: US 6,167,986 B1
(45) Date of Patent: Jan. 2, 2001

(54) FALL PROTECTION DEVICE FOR CONSTRUCTION SITES

(76) Inventor: Ronald E. Calvillo, P.O. Box 1135, San Martin, CA (US) 95046

( * ) Notice: Under 35 U.S.C. 154(b), the term of this patent shall be extended for 0 days.

(21) Appl. No.: 09/418,638

(22) Filed: Oct. 15, 1999

(51) Int. Cl.[7] ..... E04G 3/00
(52) U.S. Cl. ..... 182/45; 182/113
(58) Field of Search ..... 182/45, 113, 3

(56) References Cited

U.S. PATENT DOCUMENTS

| | | | | |
|---|---|---|---|---|
| 2,833,503 | * | 5/1958 | Harshbarger | 182/113 |
| 3,938,619 | * | 2/1976 | Kurabayashi | 182/113 |
| 4,122,916 | * | 10/1978 | Strobel | 182/45 |
| 5,307,897 | * | 5/1994 | Turner | 182/113 |
| 5,515,941 | * | 5/1996 | Palmer | 182/45 |
| 5,638,917 | * | 6/1997 | Vennen | 182/113 |
| 5,718,305 | * | 2/1998 | Palmer | 182/45 |

FOREIGN PATENT DOCUMENTS

| | | | | |
|---|---|---|---|---|
| 1321617 | * | 2/1963 | (FR) | 182/82 |

* cited by examiner

*Primary Examiner*—Alvin Chin-Shue
(74) *Attorney, Agent, or Firm*—The Kline Law Firm

(57) ABSTRACT

A fall protection device that includes at least a pair of lifeline anchors that are affixed to a wall frame before the frame is tilted up into place. The anchors include a base body that extends outward so that the device can clear the roof overhang so that it can remain in place throughout the construction of the roof. Support members provide sufficient rigidity so that the device has the requisite pull resistance to meet all applicable regulations. A lifeline mount arm is mounted on an upward extension of a base body, and the lifeline is secured between a pair of mount arms.

12 Claims, 4 Drawing Sheets

FALL PROTECTION DEVICE FOR CONSTRUCTION SITES

FIELD OF THE INVENTION

The present invention relates generally to construction site safety equipment, and more particularly is a fall protection device adapted to be used on wood frame structures.

BACKGROUND OF THE INVENTION

One of the more dangerous jobs in construction is roofing work, particularly framing. The problem is that until the trusses are installed, there is literally nothing to hold onto for the workers. Therefore falls from the top of the framed walls of buildings are all too commonplace.

Even after the roof is framed, if the roof is pitched, as most are, the angle of the roof makes footing far more hazardous than on a flat surface. Poor weather conditions can make a slanted roof a very slippery place to walk. Accordingly, builders have tried to provide various safety devices to protect workers building a roof. Many of these devices include mounting a "lifeline" that allows workers to clip a safety belt onto a secured line to minimize their danger of being injured in a fall.

One difficulty encountered in designing lifeline securing devices is that they of course must be secured to something. The most convenient place to mount anchors for a lifeline for roof work in on a pair of spaced rafters or trusses. However, using the trusses as mounting points means that at least two of the trusses must be installed without any safety device.

Extending lifeline mounts vertically from the wall members is also less than ideal. The roof rafters ordinarily extend past the plane of the walls. When the sheeting is to be put on the roof, lifeline mounts extending vertically from the wall members must be removed before the sheeting can be secured.

All these problems will be exacerbated in the year 2000, when OSHA regulations will require that all construction workers working at a height of seven feet or more must have a fall prevention device available.

Accordingly, it is an object of the present invention to provide a fall protection device for workers on a roof that has lifeline anchors mounted on wall frame members. The lifeline anchors must be able to remain in place when the roof sheeting is installed.

It is a further object of the present invention to provide a fall protection device that meets all OSHA requirements.

It is a still further object of the present invention to provide a fall protection device that is easy and inexpensive to manufacture.

SUMMARY OF THE INVENTION

The present invention is a fall protection device that comprises at least a pair of lifeline anchors. The anchors are affixed to a wall frame before the frame is tilted up into place. The anchors include an extension means that enables the device to clear the roof overhang so that it can remain in place throughout the construction of the roof. Support members provide sufficient rigidity so that the device has the requisite pull resistance to meet all applicable regulations. A lifeline mount arm extends upward from the extension means, and the lifeline is secured between a pair of mount arms.

An advantage of the present invention is that the device can be mounted onto the wall frame while the frame is on the ground.

Another advantage of the present invention is that it can be left in place throughout the construction process once it has been installed, thereby enabling all the trades that are employed in residential home building to utilize the device.

A still further advantage of the present invention is that it allows the members of the construction industry to be in compliance with relevant OSHA regulations.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
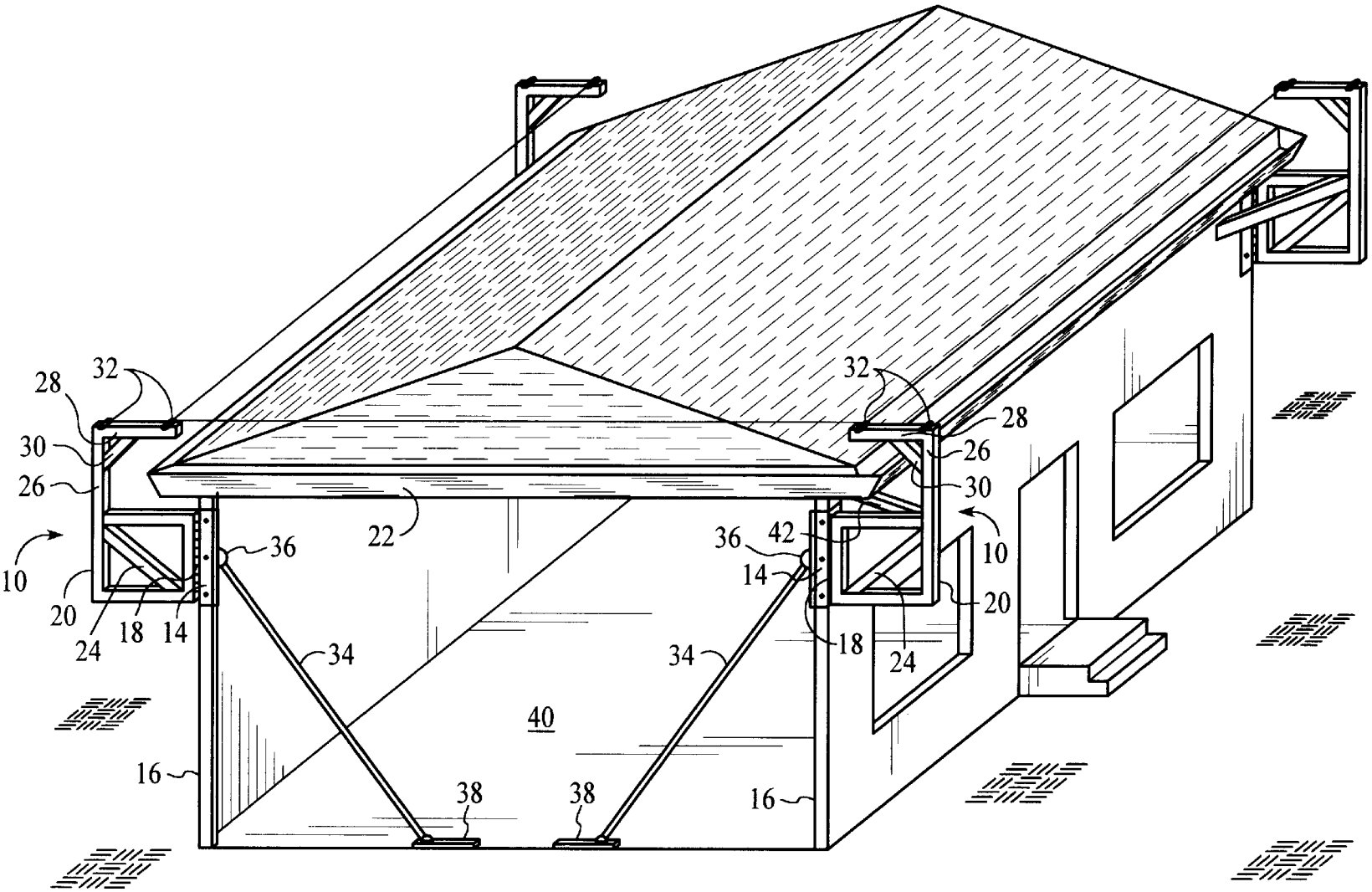
FIG. 1 is an end view of a framed building with the anchors of the fall protection device installed.
Figure 2:
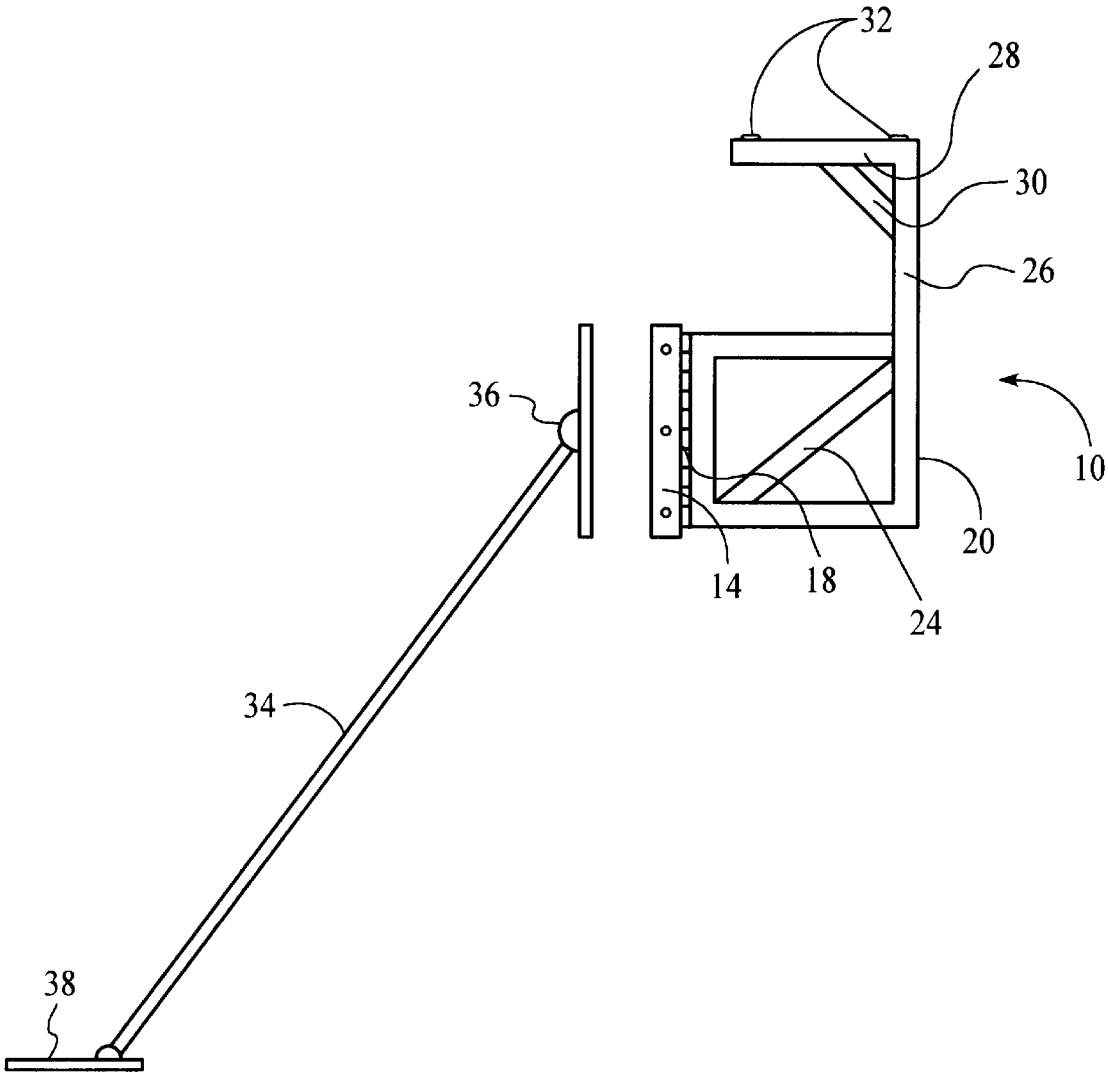
FIG. 2 is a side view of a pivoting anchor and a lower support member.
Figure 3:
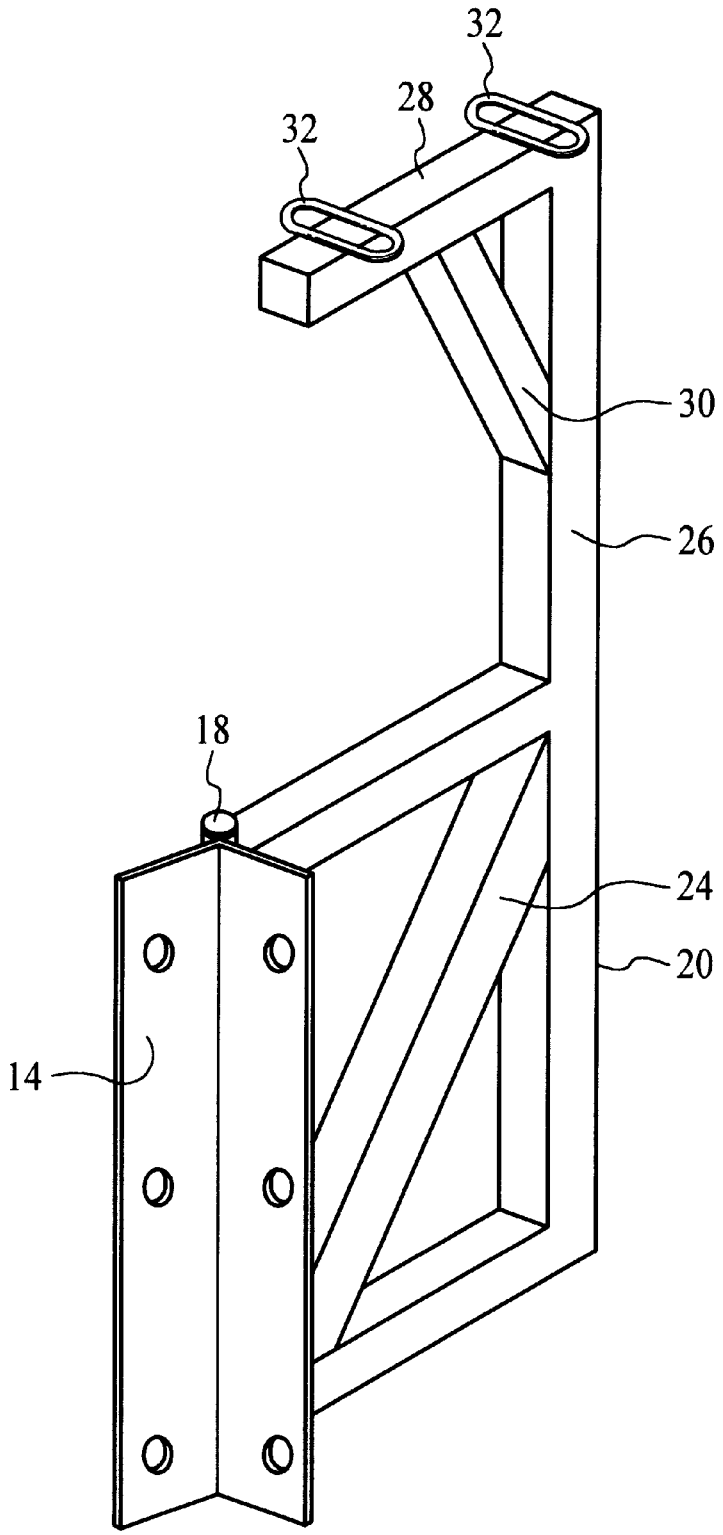
FIG. 3 is a perspective view of a pivoting anchor.
Figure 4:
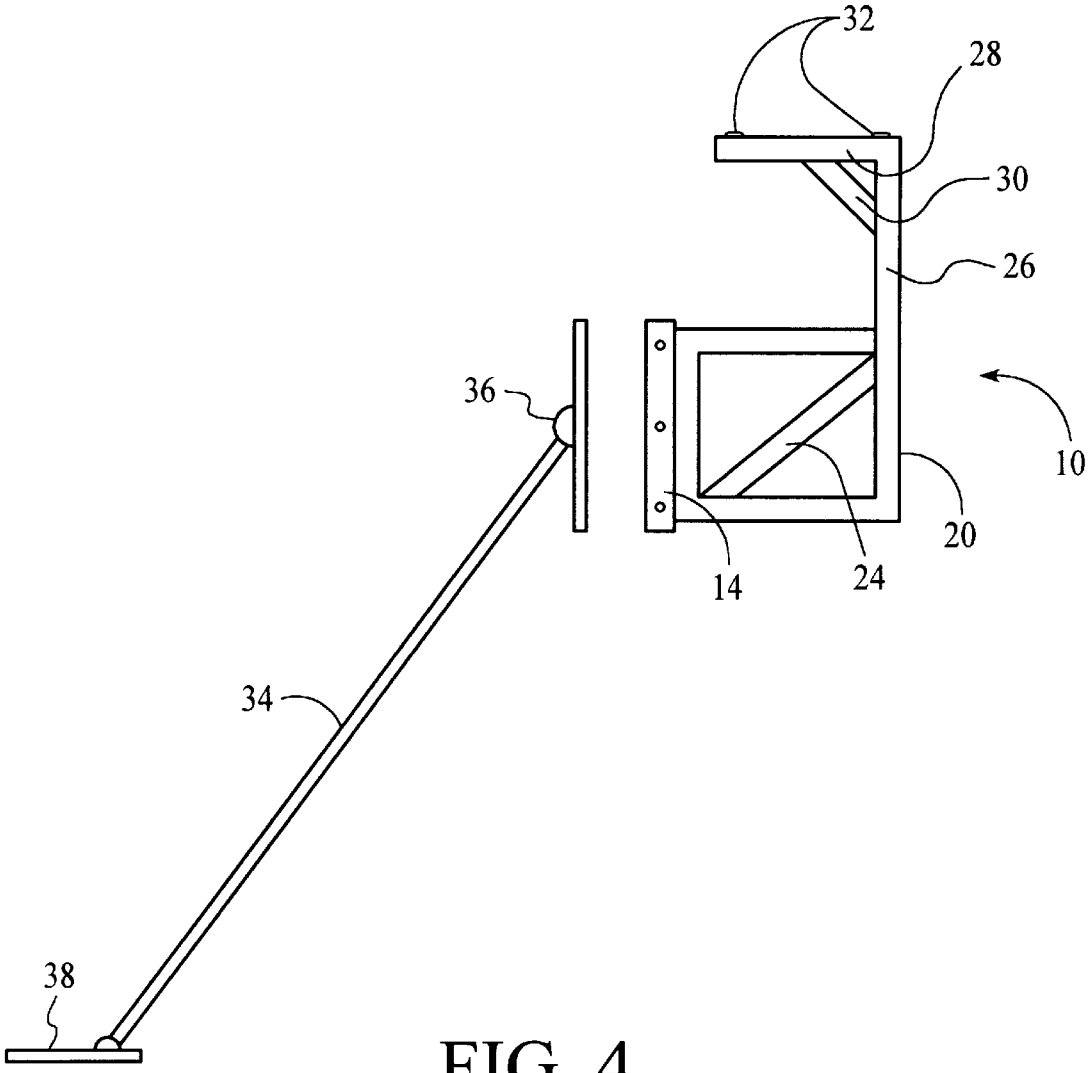
FIG. 4 is a side view of a fixed anchor and a lower support member.
Figure 5:
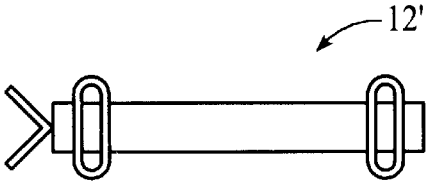
FIG. 5 is a top view of a fixed anchor with a 45° mounting plate.
Figure 6:
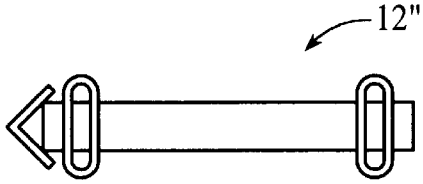
FIG. 6 is a top view of a fixed anchor with an inside corner mounting plate.

The present invention is a fall protection device for wood frame buildings that comprises at least a pair of lifeline anchors. The anchors are affixed to the frame of a building under construction, and then a lifeline is secured between pairs of the anchors. A worker clips his safety belt to the lifeline to implement the fall protection device of the present invention.

The anchors may either be a pivoting anchor 10, or a fixed anchor 12. The anchors 10, 12 comprise a mounting plate 14 that is used to secure the device to one of the frame members 16. In the preferred embodiment, the frame member 16 is a 4"×4" post included in the frame layout. The mounting plate 14 is typically a piece of angle iron, so that the mounting plate 14 can be secured to at least two sides of the frame member 16 for sufficient support. In certain installations, the mounting plate 14 may also simply be a flat piece.

Often, an anchor will be mounted near a corner of a building. In this instance, the pivoting anchor 10 is beneficial. A hinge means 18 is mounted on the device between the mounting plate 14 and a base body 20 of the anchor 10. In all other respects, the construction of the two anchors 10, 12 is equivalent.

The base body 20, in addition to bearing the brunt of the load placed on the device by the lifeline, also provides an extension means for the device to clear the roof overhang 22. In the preferred embodiment, the base body 20 is a rectangular member, and will typically be constructed from 1½" square box metal stock. It is envisioned that aluminum will be the preferred material. A diagonal base support gusset 24 is provided to give additional rigidity to the base body 20. The base support gusset 24 will generally be made from the same material as the base body 20.

A rear member of the base body 20 extends upward to form a vertical rise member 26. For maximum strength of the anchor, it is preferred, although not strictly required, that the vertical rise member 26 be an integral portion of the base body 20. A lifeline mount arm 28 extends inward from the vertical rise member 26. An upper support gusset 30 lends additional support to the lifeline mount arm 28, and to the vertical rise member 26/lifeline mount arm 28 joint. In the preferred embodiment, these elements will also be constructed from 1½" square box metal stock. It is envisioned that aluminum will be the preferred material for the elements of the lifeline anchors.

The lifeline is secured to a receiving element 32. One or more of the receiving elements 32 are provided on the mount arm 28. The lifeline is mounted between a pair of anchors and then pulled to the requisite tension. The anchors can of course be any combination of pivoting and fixed anchors. Numerous lifelines and compatible tightening mechanisms for them are known in the art, and are thus not described in detail herein.

Even with the sturdy construction members of the anchor device, additional load support may sometimes be required. One means of additional load support is an interior support arm 34. The interior support arm 34 will be provided with a wall mount 36 and a floor mount 38. The mounting elements 36, 38 are pivoting so that the interior support arm 34 can be adjusted to different mounting heights of the anchors 10, 12. The wall mount 36 is affixed to the frame member 16, and the floor mount 38 is secured to the floor 40 or to a floor joist to install the interior support arm 34.

If still further support is desired, an exterior support arm 42 can be installed between the anchor 10, 12 and the frame. One end of the exterior support arm 42 will be pivotally attached to the anchor 10, 12, generally by bolting at the connection point of the base body 20 and the vertical rise member 26. The other end will be secured by a pivoting exterior wall mount to the frame.

Use of the fall protection device of the present invention is as follows: The frame of the building is laid out with an anchor 10, 12 at each ends of each planned span of lifeline. The anchors 10, 12 will be affixed to the frame members 16 before the walls are tilted up into place. Thus when the walls are raised, the safety anchors 10, 12 are automatically in place.

For anchor positions on corners, it will generally be preferable to use a pivoting anchor 10. One anchor 10 can then be used for lifelines on two sides of the building frame. The anchor 10 cannot of course be used in two lifelines simultaneously, but after installation and use for one lifeline, the anchor 10 can be pivoted to secure a lifeline on another side of the frame. If the user has chosen a fixed anchor 12, the mounting plate 14 can be modified to mount the anchor 12' at a 45° angle or on an inside corner, anchor 12".

Once the walls are raised, the anchors 10, 12 are in place to install one or more lifelines. By including the anchors 10, 12 in the framing layout, the user can install all necessary lifelines while the frame is on the ground. To use fewer anchors, the user can of course choose to move the anchors after work on a given section is completed, and simply use one lifeline at a time.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A fall protection device with a wood frame building comprising:

at least two anchors, said anchors are adapted to secure a safety lifeline, wherein each said anchor comprises;

a mounting plate, a base body secured to said mounting plate, a vertical rise member extending upward from said base body, a lifeline mount arm extending inward from said vertical rise member, and a receiving element on said lifeline mount arm, said receiving element is adapted to receive and to secure the safety lifeline; and wherein each said anchor is secured to a wall frame member of a building by means of said mounting plate such that each said base body extends outward from said wall frame member so that each said vertical rise member clears an overhang of a roof of said building, each said vertical rise member extends upward so that each said receiving element is at a height desired for the safety lifeline, and each said lifeline mount arm extends inward a sufficient distance so that each said receiving element is over said roof of said building, such that the safety lifeline is over said roof of said building when the safety lifeline is secured between said at least two anchors, said outward extending base body and said inward extending mount arm enabling a user to affix said anchors to said wall frame member prior to said wall frame member being raised on a foundation of said building.

2. The fall protection device of claim 1 wherein:

a hinge means is installed in said anchor between said mounting plate and said base body so that an angle of said base body relative to a wall of said building can be changed by a user of said device.

3. The fall protection device of claim 1 wherein:

said base body includes a base support gusset that spans a length of said base body.

4. The fall protection device of claim 1 wherein:

said anchor includes an upper support gusset that is installed between said vertical rise member and said lifeline mount arm.

5. The fall protection device of claim 1 wherein:

said device further includes an interior support arm comprising a wall mount means and a floor mount means, such that said interior support arm is installed with said wall mount means affixed to said wall frame member of said building and said floor mount means affixed to a floor or a floor joist of said building.

6. The fall protection device of claim 1 wherein:

said device further includes an exterior support arm, a first end of said exterior support arm is pivotally attached to said base body or to said vertical rise member, and a second end of said exterior support member is affixed to said wall frame member of said building.

7. The fall protection device of claim 1 wherein:

said mounting plate is affixed to said base body such that said base body extends from a wall of said building at a 45° angle.

8. The fall protection device of claim 1 wherein:

said mounting plate includes means to be received in an inside corner of a wall of said building.

9. The fall protection device of claim 2 wherein:

said base body includes a base support gusset that spans a length of said base body.

10. The fall protection device of claim 2 wherein:

said anchor includes an upper support gusset that is installed between said vertical rise member and said lifeline mount arm.

11. The fall protection device of claim 2 wherein:

said device further includes an interior support arm comprising a wall mount means and a floor mount means, such that said interior support arm is installed with said wall mount means affixed to said wall frame member of said building and said floor mount means affixed to a floor or a floor joist of said building.

12. The fall protection device of claim 2 wherein:

said device further includes an exterior support arm, a first end of said exterior support arm is pivotally attached to said base body or to said vertical rise member, and a second end of said exterior support member is affixed to said wall frame member of said building.

* * * * *